US008343906B2

(12) United States Patent
Bettiol et al.

(10) Patent No.: US 8,343,906 B2
(45) Date of Patent: Jan. 1, 2013

(54) ALKALINE LIQUID HAND DISH WASHING DETERGENT COMPOSITION

(75) Inventors: Jean-Luc Philippe Bettiol, Brussels (BE); Salua Morabet, Brussels (BE); Stefano Scialla, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/966,087

(22) Filed: Dec. 13, 2010

(65) Prior Publication Data

US 2011/0152158 A1 Jun. 23, 2011

(30) Foreign Application Priority Data

Dec. 22, 2009 (EP) ..... 09180278
Sep. 21, 2010 (EP) ..... 10177812

(51) Int. Cl.
*C11D 1/02* (2006.01)
*C11D 1/75* (2006.01)
*C11D 3/395* (2006.01)
*C11D 3/43* (2006.01)

(52) U.S. Cl. ..... 510/237; 510/101; 510/372; 510/427; 510/432; 510/433; 510/434; 510/477; 510/488; 510/503; 510/505; 510/506

(58) Field of Classification Search ..... 510/101, 510/237, 372, 427, 432, 433, 434, 477, 488, 510/503, 505, 506; 134/25.2
See application file for complete search history.

(56) References Cited

U.S. PATENT DOCUMENTS

| | | | | |
|---|---|---|---|---|
| 2,503,280 | A | 4/1950 | Lockwood | |
| 2,507,088 | A | 5/1950 | Bradley | |
| 3,260,744 | A | 7/1966 | Ito et al. | |
| 3,372,188 | A | 3/1968 | Alston et al. | |
| 3,812,044 | A | 5/1974 | Connor et al. | |
| 3,915,903 | A | 10/1975 | Wise | |
| 4,663,071 | A | 5/1987 | Bush et al. | |
| 4,704,233 | A | 11/1987 | Hartman et al. | |
| 5,244,593 | A | 9/1993 | Roselle et al. | |
| 5,798,505 | A | 8/1998 | Lee | |
| 6,008,181 | A | 12/1999 | Cripe et al. | |
| 6,020,303 | A | 2/2000 | Cripe et al. | |
| 6,060,443 | A | 5/2000 | Cripe et al. | |
| 6,187,738 | B1 | 2/2001 | Micciche et al. | |
| 6,426,229 | B1 | 7/2002 | Yamamoto et al. | |
| 6,475,970 | B1 * | 11/2002 | Del Duca et al. | 510/375 |
| 6,495,501 | B1 * | 12/2002 | Del Duca et al. | 510/283 |
| 2002/0193270 | A1 * | 12/2002 | Cermenati et al. | 510/302 |
| 2002/0193278 | A1 * | 12/2002 | Cermenati et al. | 510/465 |
| 2003/0045439 | A1 * | 3/2003 | Evers | 510/238 |
| 2004/0097391 | A1 * | 5/2004 | Chiaradonna et al. | 510/312 |
| 2005/0227892 | A1 * | 10/2005 | Shaukat et al. | 510/302 |

FOREIGN PATENT DOCUMENTS

| | | | |
|---|---|---|---|
| DE | 10 2005 000955 | A1 | 7/2006 |
| EP | 0 209 228 | A1 | 1/1987 |
| EP | 0 843 001 | B1 | 4/2003 |
| EP | 0 859 044 | B1 | 1/2005 |
| WO | WO 97/25397 | A1 | 7/1997 |
| WO | WO 99/05082 | A1 | 2/1999 |
| WO | WO 99/05084 | A1 | 2/1999 |
| WO | WO 99/05241 | A1 | 2/1999 |
| WO | WO 99/05242 | A1 | 2/1999 |
| WO | WO 99/05243 | A1 | 2/1999 |
| WO | WO 99/05244 | A1 | 2/1999 |
| WO | WO 99/07656 | A2 | 2/1999 |
| WO | WO 00/23548 | A1 | 4/2000 |
| WO | WO 00/23549 | A1 | 4/2000 |
| WO | WO 2006/014740 | A1 | 2/2006 |
| WO | WO 2007/135645 | A2 | 11/2007 |
| WO | WO 2007/138053 | A1 | 12/2007 |

OTHER PUBLICATIONS

International Search Report, International Application No. PCT/US2010/061269, mailed Mar. 16, 2011, 13 pages.
WPI World Patent Information Derwent, vol. 26, No. 91, 1991, XP002029434.

* cited by examiner

*Primary Examiner* — Gregory Delcotto
(74) *Attorney, Agent, or Firm* — John T. Dipre; Steven W. Miller

(57) ABSTRACT

An alkaline liquid hand dish washing detergent composition to provide superior stain removal and superior stability during storage and use.

15 Claims, 1 Drawing Sheet

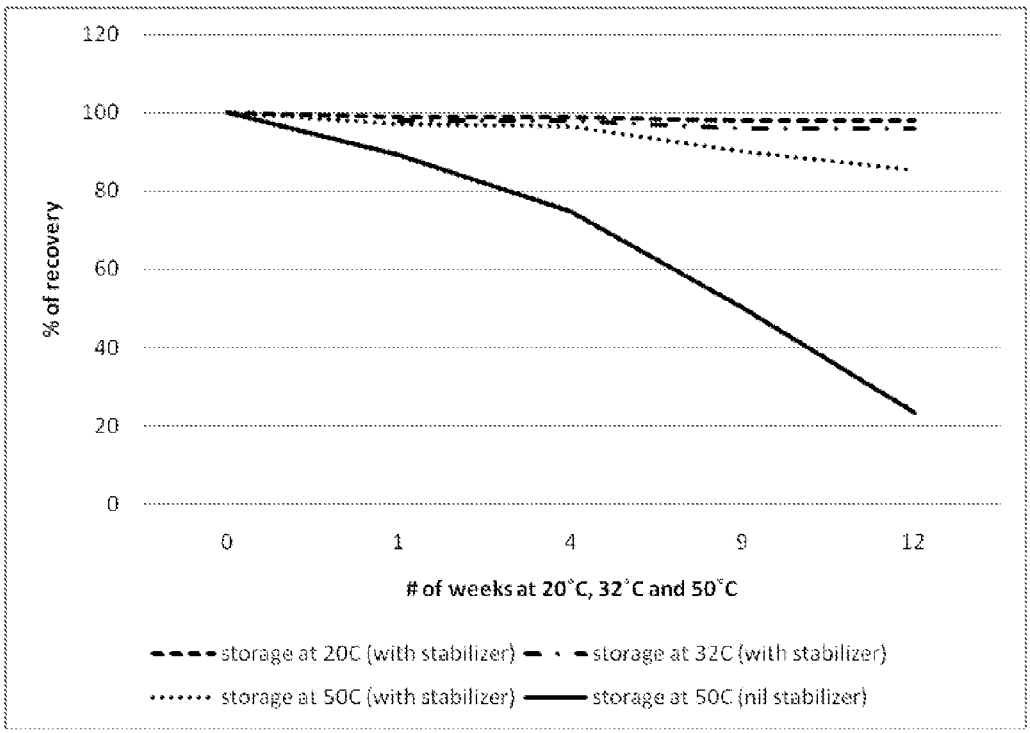
$H_2O_2$ stability at various storage conditions for a formula of Example 1

ALKALINE LIQUID HAND DISH WASHING DETERGENT COMPOSITION

FIELD OF INVENTION

The present invention relates to an alkaline liquid hand dish washing detergent composition comprising bleach.

BACKGROUND OF THE INVENTION

Optimisation of cleaning is an ongoing task in the field of hand dishwashing. Consumers utilizing liquid detergent as a liquid hand dishwashing detergent compositions require fast and effective cleaning action, odor control and hygiene.

Aqueous compositions comprising peroxygen bleach have generally been less utilized in the household dish washing detergent market, although they deliver effective bleaching performance and/or disinfecting performance. Currently liquid hand dish washing detergents are meant for greasy soil removal, but fail to some extent to effectively remove tea, coffee and red stains, red stains including tomato and red fruit stains. Thus there is a need to provide an alkaline liquid hand dish washing detergent composition that meets this need to remove bleachable stains. Thus there is a desire for a liquid hand dish washing detergent formulation containing bleach.

Primarily the instability of the peroxygen bleach is an issue in alkaline medium, usually used to formulate alkaline liquid hand dish washing detergent compositions. The peroxide bleach instability is caused principally by contamination of metal ion occurring in the composition itself and/or in wash solution obtained having diluted the composition with water. It is also well known from the literature that, hydrogen peroxide is unstable at a pH greater than 7.

It is thus objective of the present invention to provide an alkaline liquid detergent composition for hand dishwashing comprising peroxygen bleach which has effective stain removal, provides odor and hygiene control and provides superior stability during storage and use. It has surprisingly been found that the above objective can be met by the composition according to the present invention.

U.S. Pat. No. 6,187,738 discloses aqueous compositions comprising peroxygen compound for removing water and protein-type stains from fabrics and carpets. U.S. Pat. No. 5,244,593 discloses aqueous, colorless detergent compositions containing anionic and/or nonionic surfactant, oxygen bleach and metal sequestering agent. EP 0 843 001 discloses stable, aqueous alkaline peroxygen bleach-containing compounds for surface cleaning.

SUMMARY OF THE INVENTION

The present application relates to an alkaline liquid hand dish washing detergent composition comprising less than 80% water by weight of the composition and comprising a) hydrogen peroxide or a water-soluble source thereof or mixture thereof;
b) an anionic surfactant or a mixture thereof;
c) an amine oxide surfactant or a mixture thereof;
d) a chelant or a mixture thereof, and
e) a free radical scavenger or a mixture thereof.

BRIEF DESCRIPTION OF THE FIGURES

FIG. 1 is a graph showing the stability of the samples of the alkaline liquid hand dish washing detergent composition plotted by % recovery function of time.

DETAILED DESCRIPTION OF THE INVENTION

An alkaline liquid hand dish washing detergent composition of the present invention surprisingly provides excellent cleaning of colored stains in addition to grease soil removal combined with superior stability of the alkaline liquid hand dish washing detergent composition.

As used herein "alkaline liquid hand dish washing detergent composition" refers to those compositions that are suitable for manual (i.e. hand) dishwashing. Such compositions are generally high sudsing or foaming in nature.

As used herein "cleaning" means applying the alkaline liquid hand dish washing detergent composition to a surface for the purpose of cleaning and/or disinfecting.

As used herein "dishware" means a surface such as dishes, glasses, pots, pans, baking dishes and flatware made from ceramic, china, metal, glass, plastic (polyethylene, polypropylene, polystyrene, etc.) and wood.

As used herein "stable" it is meant an alkaline liquid hand dish washing detergent composition which does not macroscopically separate into distinct layers upon standing at least two weeks at 20° C. (physical or phase stability), more preferably at least six months at 20° C. and the hydrogen peroxide does not decompose under these conditions (chemical stability).

The Alkaline Liquid Hand Dishwashing Detergent Composition

The compositions of the present invention provide odor and hygiene control, superior stain removal and superior stability during storage and use. Odor control is provided by oxidizing compounds causing the food odor by hydrogen peroxide. Additionally hygiene control is provided by killing the germs by hydrogen peroxide. Superior stain removal means removal of red stains such as tomato and red fruits and removal of hydrophilic stains such as beverage, tea, coffee and wine, in addition to removal of greasy stains.

Because of its strong ability to remove colour, hydrogen peroxide has been used widely in the removal of stains. However the problem concerning the stability of hydrogen peroxide in alkaline conditions has hindered the use in hand dishwashing detergent compositions.

Without wishing to be bound by theory, it is believed that a combination of amine oxide surfactant, anionic surfactant, chelant and free radical scavenger ensures superior stability of hydrogen peroxide in alkaline liquid hand dish washing detergent composition in a pH from 8.0 to 10.0, preferably from 8.0 to 8.9 and most preferably from 8.5 to 8.9.

The alkaline liquid detergent compositions herein contains less than 80% of water, preferably from 30% to 80%, more preferably 30% to 75%, most preferably 40% to 75% of water by weight of the alkaline liquid hand dish washing detergent composition. The other essential and optional composition components are dissolved, dispersed or suspended into water.

The essential components of alkaline liquid detergent composition:

The Peroxide Bleach

As a first essential ingredient, the composition according to the present invention comprises peroxide bleach or a mixture thereof. Preferred peroxide bleaches are hydrogen peroxide or a water-soluble source thereof or a mixture thereof. Said water-soluble sources are selected from the group consisting of perborate salts, percarbonate salts, urea peroxide, monopersulfate and persulfate salts and mixtures thereof.

The composition of the present invention comprises a hydrogen peroxide from 0.1% to 15% by weight of the composition, preferably from 0.2% to 10%, more preferably from 0.3% to 6% by weight of the alkaline liquid hand dish washing detergent composition.

The Amine Oxide Surfactant

As a second essential ingredient, the composition of the present invention comprises a linear amine oxide surfactant or a mixture thereof.

Typical linear amine oxides include water-soluble amine oxides containing one $R_1$ $C_{8-18}$ alkyl moiety and two $R_2$ and $R_3$ moieties selected from the group consisting of $C_{1-3}$ alkyl groups and $C_{1-3}$ hydroxyalkyl groups. Preferably amine oxide is characterized by the formula $R_1$—$N(R_2)(R_3)$→O wherein $R_1$ is a $C_{8-18}$ alkyl and $R_2$ and $R_3$ are selected from the group consisting of methyl, ethyl, propyl, isopropyl, 2-hydroxethyl, 2-hydroxypropyl and 3-hydroxypropyl. The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. Preferred amine oxides to be used herein are selected from the group consisting of linear $C_{10}$, linear $C_{10}$-$C_{12}$, and linear $C_{12}$-$C_{14}$ alkyl dimethyl amine oxides.

The composition of the present invention comprises an amine oxide surfactant or a mixture thereof at a level of from 1% to 12%, preferably from 1% to 10%, more preferably from 3% to 5% by weight of the alkaline liquid hand dish washing detergent composition.

The Chelant

As a third essential ingredient, the composition of the present invention comprises a chelant or a mixtures thereof.

Suitable chelating agents are selected from the group consisting of amino carboxylates, amino phosphonates and polufunctionally-substituted aromatic chelating agents and mixtures thereof.

Preferred chelants to be used herein are the amino acids based chelants and preferably glutamic-N,N-diacetic acid and derivatives and/or phosphonate based chelants and preferably diethylenetriamine penta methylphosphonic acid.

Amino carboxylates include ethylenediaminetetra-acetates, N-hydroxy ethylethylenediaminetriacetates, nitrilotriacetates, ethylenediamine tetrapro-prionates, triethylenetetraaminehexacetates, diethylenetriaminepentaacetates, and ethanoldi-glycines, alkali metal, ammonium, and substituted ammonium salts therein and mixtures therein. As well as methyl-glycine-diacetic acid (MGDA), and salts and derivatives thereof and glutamic-N,N-diacetic acid (GLDA) and salts and derivatives thereof. GLDA (salts and derivatives thereof) is especially preferred according to the invention, with the tetrasodium salt thereof being especially preferred.

Other suitable chelants include amino acid based compound or a succinate based compound. Other suitable chelants are described in U.S. Pat. No. 6,426,229. Particular suitable chelants include; for example, aspartic acid-N-monoacetic acid (ASMA), aspartic acid-N,N-diacetic acid (ASDA), aspartic acid-N-monopropionic acid (ASMP), iminodisuccinic acid (IDS), imino diacetic acid (IDA), N-(2-sulfomethyl) aspartic acid (SMAS), N-(2-sulfoethyl) aspartic acid (SEAS), N-(2-sulfomethyl) glutamic acid (SMGL), N-(2-sulfoethyl) glutamic acid (SEGL), N-methyliminodiacetic acid (MIDA), DL-alanine-N,N-diacetic acid (DL-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof. Also suitable is ethylenediamine disuccinate ("EDDS"), especially the [S,S] isomer as described in U.S. Pat. No. 4,704,233. Furthermore, hydroxyethyleneiminodiacetic acid, hydroxyiminodisuccinic acid, hydroxyethylene diaminetriacetic acid are also suitable.

Other chelants include homopolymers and copolymers of polycarboxylic acids and their partially or completely neutralized salts, monomeric polycarboxylic acids and hydroxycarboxylic acids and their salts. Preferred salts of the above-mentioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethyl enedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Preferred are the polycarboxylates end capped with sulfonates.

Amino phosphonates are also suitable to be used as chelating agents and include ethylenediaminetetrakis (methylenephosphonates) as DEQUEST. Preferably these amino phosphonates do not contain alkyl or alkenyl groups with more than 6 carbon atoms.

Polyfunctionally-substituted aromatic chelating agents are also useful in the compositions herein such as described in U.S. Pat. No. 3,812,044. Preferred compounds of this type in acid form are dihydroxydisulfobenzenes such as 1,2-dihydroxy-3,5-disulfobenzene.

Further suitable polycarboxylates chelants to be used herein include citric acid, lactic acid, acetic acid, succinic acid, formic acid all preferably in the form of a water-soluble salt. Other suitable polycarboxylates are oxodisuccinates, carboxymethyloxysuccinate and mixtures of tartrate monosuccinic and tartrate disuccinic acid such as described in U.S. Pat. No. 4,663,071.

Most preferred chelants to be used herein are selected from the group consisting of 1-hydroxy ethylidene-1,1-diphosphonic acid (HEDP), diethylene triamine penta acetic acid (DTPA), N,N-diacetic glytamic acid tetra sodium salt (GLDA), methyl glycine-N,N-diacetic acid (MGDA) and mixtures thereof. Most preferred chelant in the present invention is HEDP.

The composition of the present invention comprises a chelant or a mixture thereof at a level of from 0.001% to 5%, preferably from 0.01% to 1%, more preferably from 0.05% to 0.5% by weight of the alkaline liquid hand dish washing detergent composition.

The Free Radical Scavenger

As a third essential ingredient, the composition of the present invention comprises a free radical scavenger or a mixture thereof.

Suitable natural or synthetic hydroxyl radical (.OH) scavengers are such as dimethyl sulphoxide (DMSO), thiourea, dimethylurea, tetramethylurea, benzoic acid, ethanol, methanol, guaiacol, ethylene glycol, trimethoxy benzoic acid (TMBA) or tetrabutyl ethylidinebisphenol (Tinogard Noa). Preferred free radical scavengers to be used herein are selected from the group consisting of trimethoxy benzoic acid (TMBA), tetrabutyl ethylidinebisphenol (Tinogard Noa) and mixtures thereof.

The composition of the present invention comprises a free radical scavenger at a level of from 0.001% to 5%, preferably from 0.01% to 2% and more preferably from 0.02% to 1% by weight of the alkaline liquid hand dish washing detergent composition.

Anionic Surfactant

As a fifth essential ingredient, the composition of the present invention comprises an anionic surfactant or mixture thereof.

Suitable anionic surfactants to be used in the compositions of the present invention are sulfate surfactants, sulfosuccinate surfactants, sulfoacetate surfactants, and/or sulfonate surfactants; preferably alkyl sulfate and/or alkyl ethoxy sulfate surfactants; more preferably a combination of alkyl sulfate and/or alkyl ethoxy sulfate surfactants with average ethoxylation degree from 0.01 to 10, preferably from 0.02 to 4, more preferably from 0.03 to 2.

Suitable sulphate or sulphonate surfactants to be used in the compositions herein include water-soluble salts or acids of $C_{10}$-$C_{14}$ alkyl, aryl or hydroxyalkyl, sulphate or sulphonates. Suitable counterions include hydrogen, alkali metal cation or ammonium or substituted ammonium, but preferably sodium. Where the hydrocarbyl chain is branched, it preferably comprises $C_{1-4}$ alkyl branching units. The average percentage branching of the sulphate or sulphonate surfactant is preferably greater than 30%, more preferably from 35% to 80% and most preferably from 40% to 60% of the total hydrocarbyl chains.

Suitable sulphate or sulphonate surfactants may be selected from $C_{11}$-$C_{18}$ alkyl benzene sulphonates (LAS), $C_8$-$C_{20}$ primary, branched-chain and random alkyl sulphates (AS); $C_{10}$-$C_{18}$ secondary (2,3) alkyl sulphates; $C_{10}$-$C_{18}$ alkyl alkoxy sulphates ($AE_xS$) wherein preferably x is from 1-30; $C_{10}$-$C_{18}$ alkyl alkoxy carboxylates preferably comprising 1-5 ethoxy units; mid-chain branched alkyl sulphates as discussed in U.S. Pat. Nos. 6,020,303 and 6,060,443; mid-chain branched alkyl alkoxy sulphates as discussed in U.S. Pat. Nos. 6,008,181 and 6,020,303; modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS).

The paraffin sulphonates may be monosulphonates or disulphonates and usually are mixtures thereof, obtained by sulphonating paraffins of 10 to 20 carbon atoms. Preferred sulphonates are those of $C_{12-18}$ carbon atoms chains and more preferably they are $C_{14-17}$ chains. Paraffin sulphonates that have the sulphonate group(s) distributed along the paraffin chain are described in U.S. Pat. Nos. 2,503,280; 2,507,088; 3,260,744; 3,372,188 and in DE 735 096.

Also suitable are the alkyl glyceryl sulphonate surfactants and/or alkyl glyceryl sulphate surfactants described in the Procter & Gamble patent application WO06/014740: A mixture of oligomeric alkyl glyceryl sulfonate and/or sulfate surfactant selected from dimers, trimers, tetramers, pentamers, hexamers, heptamers, and mixtures thereof; wherein the weight percentage of monomers is from 0% to 60% by weight of the alkyl glyceryl sulfonate and/or sulfate surfactant mixture.

Other suitable anionic surfactants are alkyl, preferably dialkyl sulfosuccinates and/or sulfoacetate. The dialkyl sulfosuccinates may be a $C_{6-15}$ linear or branched dialkyl sulfosuccinate. The alkyl moieties may be symmetrical (i.e., the same alkyl moieties) or asymmetrical (i.e., different alkyl moiety.es). Preferably, the alkyl moiety is symmetrical.

Most common branched anionic alkyl ether sulphates are obtained via sulfation of a mixture of the branched alcohols and the branched alcohol ethoxylates. Also suitable are the sulfated fatty alcohols originating from the Fisher & Tropsch reaction comprising up to 50% branching (40% methyl (mono or bi) 10% cyclohexyl) such as those produced from the Safol™ alcohols from Sasol; sulfated fatty alcohols originating from the oxo reaction wherein at least 50 weight % of the alcohol is $C_2$ isomer (methyl to pentyl) such as those produced from the Isalchem™ alcohols or Lial™ alcohols from Sasol; the sulfated fatty alcohols originating from the modified oxo reaction wherein at least 15 weight % of the alcohol is $C_2$ isomer (methyl to pentyl) such as those produced from the Neodol™ alcohols from Shell.

Preferably the anionic surfactant is alkyl sulfate or alkyl ethoxylate or combination of thereof. More preferably anionic surfactant is selected from the group consisting of AS, AES having average degree of ethoxylation from 0.01 to 10, preferably from 0.02 to 4, more preferably for 0.03 to 3 or mixtures thereof.

The anionic surfactant herein is typically present at a level from 12% to 60%, preferably from 14% to 50% and more preferably from 16% to 40% by weight of alkaline liquid hand dish washing detergent composition.

The optional components of the alkaline liquid hand dish washing detergent composition are:

Additional Surfactant System

The composition of the present invention may comprise an additional surfactant system selected from the group consisting of nonionic, cationic, amphoteric, zwitterionic, semi-polar nonionic surfactants, and mixtures thereof.

The surfactants described below can be used in their linear and/or branched versions.

Nonionic Surfactants

Preferred to be used in the present invention, as optionally added surfactants, are nonionic surfactants. Indeed, it has been found that the addition of nonionic surfactants and preferably of branched nonionic surfactants, will prevent efficiently the formation of crystalline films of the dish surface and will provide improved wetting and thereby providing superior shine.

The nonionic surfactant, when present, is comprised in a typical amount of from 0.01% to 30%, preferably 0.1% to 20% by weight of alkaline liquid hand dish washing detergent composition and more preferably from 1.5 to 10% by weight of the alkaline liquid hand dish washing detergent composition.

Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 8 to 18 carbon atoms, preferably from 9 to 15 carbon atoms with from 2 to 18 moles, preferably 2 to 15, more preferably 5-12 of ethylene oxide per mole of alcohol.

Also suitable are alkylpolyglycosides having the formula $R_4O(C_nH_{2n}O)_t(\text{glycosyl})_x$, wherein $R_4$ is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n is 2 or 3, preferably 2; t is from 0 to 10, preferably O; and x is from 1.3 to 10, preferably from 1.3 to 3, most preferably from 1.3 to 2.7. The glycosyl is preferably derived from glucose. Also suitable are alkyl glycerol ethers and sorbitan esters.

Also suitable are fatty acid amide surfactants having the formula:

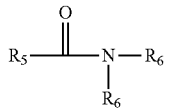

wherein $R_5$ is an alkyl group containing from 7 to 21, preferably from 9 to 17, carbon atoms and each $R_6$ is selected from the group consisting of hydrogen, $C_1$-$C_4$ alkyl, $C_1$-$C_4$ hydroxyalkyl, and —$(C_2H_4O)_xH$, where x varies from 1 to 3. Preferred amides are $C_8$-$C_{20}$ ammonia amides, monoethanolamides, diethanolamides, and isopropanolamides.

Preferred nonionic surfactants to be used in the present invention are the condensation products of aliphatic alcohols with ethylene oxide, such as the mixture of nonyl ($C_9$), decyl ($C_{10}$) undecyl ($C_{11}$) alcohol modified with on average 5 ethylene oxide (EO) units such as the commercially available Neodol 91-5 or the Neodol 91-8 that is modified with on average 8 EO units. Also suitable are the longer alkyl chains ethoxylated nonionics such as $C_{12}$, $C_{13}$ modified with 5 EO (Neodol 23-5). Neodol is a Shell tradename. Also suitable is the $C_{12}$, $C_{14}$ alkyl chain with 7 EO, commercially available under the trade name Novel 1412-7 (Sasol) or the Lutensol A 7 N (BASF).

Preferred branched nonionic surfactants are the Guerbet $C_{10}$ alcohol ethoxylates with 5 EO such as Ethylan 1005, Lutensol XP 50 and the Guerbet $C_{10}$ alcohol alkoxylated nonionics (modified with EO and PO=propyleneoxyde) such as the commercially available Lutensol XL series (X150, XL70). Other branching also include oxo branched nonionic surfactants such as the Lutensol ON 50 (5 EO) and Lutensol ON70 (7 EO). Other suitable branched nonionics are the ones derived from the isotridecyl alcohol and modified with ethyleneoxyde such as the Lutensol TO7 (7EO) from BASF and the Marlipal O 13/70 (7EO) from Sasol. Also suitable are the ethoxylated fatty alcohols originating from the Fisher & Tropsch reaction comprising up to 50% branching (40% methyl (mono or bi) 10% cyclohexyl) such as those produced from the Safol™ alcohols from Sasol; ethoxylated fatty alcohols originating from the oxo reaction wherein at least 50 weight % of the alcohol is C2 isomer (methyl to pentyl) such as those produced from the Isalchem™ alcohols or Lial™ alcohols from Sasol; the ethoxylated fatty alcohols originating from the modified oxo reaction wherein at least 15 weight % of the alcohol is $C_2$ isomer (methyl to pentyl) such as those produced from the Neodol™ alcohols from Shell.

Amphoteric/zwitterionic Surfactants

The amphoteric and zwitterionic surfactant when present in the composition can be comprised at a level of from 0.01% to 10%, preferably from 0.5% to 10 by weight of the liquid detergent composition. The compositions of the present invention will preferably further comprise a betaine or a mixture thereof.

Other suitable surfactants include betaines such alkyl betaines, alkylamidobetaine, amidazoliniumbetaine, sulfobetaine (INCI Sultaines) as well as the phosphobetaine and preferably meets formula:

$$R_7—[CO—X(CH_2)_n]_x—N^+(R_8)(R_9)—(CH_2)_m—[CH(OH)—CH_2]_y—Y \text{ wherein}$$

$R_7$ is a saturated or unsaturated $C_{6-22}$ alkyl residue, preferably $C_{8-18}$ alkyl residue, more preferably a saturated $C_{10-16}$ alkyl residue, for example a saturated $C_{12-14}$ alkyl residue;

X is NH, $NR_4$ with $C_{1-4}$ alkyl residue $R_4$, O or S;

n is a number from 1 to 10, preferably 2 to 5, more preferably 3;

x is 0 or 1, preferably 1;

$R_8$, $R_9$ are independently a $C_{1-4}$ alkyl residue, potentially hydroxy substituted such as a hydroxyethyl, preferably a methyl;

m is a number from 1 to 4, preferably 1, 2 or 3;

y is 0 or 1 and;

Y is $COO^-$, $SO_3$, $OPO(OR_{10})O$ or $P(O)(OR_{10})O$, whereby $R_{10}$ is a hydrogen atom H or a $C_{1-4}$ alkyl residue.

Preferred betaines are the alkyl betaines (a), the alkyl amido betaine (b), the sulfo betaines (c) and the amido sulfobetaine (d);

$$R_{11}—N^+(CH_3)_2—CH_2COO^- \quad (a)$$

$$R_{11}—CO—NH(CH_2)_3—N^+(CH_3)_2—CH_2COO^- \quad (b)$$

$$R_{11}—N^+(CH_3)_2—CH_2CH(OH)CH_2SO_3— \quad (c)$$

$$R_{11}—CO—NH—(CH_2)_3—N^+(CH_3)_2—CH_2CH(OH)CH_2SO_3— \quad (d)$$

in which $R_{11}$ is a saturated or unsaturated $C_{6-22}$ alkyl residue, preferably $C_{8-18}$ alkyl residue, in particular a saturated $C_{10-16}$ alkyl residue, for example a saturated $C_{12-14}$ alkyl residue, preferred betaines are the carbobetaine, wherein $Y^-$=$COO^-$; preferably the Carbobetaine of the formula (a) and (b), more preferred are the Alkylamidobetaine of the formula (b).

Examples of suitable betaines and sulfobetaine are the following: almondamidopropyl betaines, Apricot amidopropyl betaines, avocado amidopropyl betaines, babassuamidopropyl betaines, behen amidopropyl betaines, behenyl betaines, betaines, canol amidopropyl betaines, capryl/capramidopropyl betaines, carnitine, cetyl of betaines, cocamidoethyl of betaines, cocamidopropyl betaines, cocamidopropyl hydroxysultaine, coco betaines, coco hydroxysultaine, coco/oleamidopropyl betaines, coco sultaine, decyl betaines, dihydroxyethyl oleyl glycinate, dihydroxyethyl soy glycinate, dihydroxyethyl stearyl glycinate, dihydroxyethyl tallow glycinate, dimethicone propyl pg-betaines, erucamidopropyl hydroxysultaine, hydrogenated tallow betaines, isostearamidopropyl betaines, lauramidopropyl betaines, lauryl betaines, lauryl hydroxysultaine, lauryl sultaine, milk amidopropyl betaines, mink amidopropyl betaines, myristamidopropyl betaines, myristyl betaines, oleamidopropyl betaines, oleamidopropyl hydroxysultaine, oleyl betaines, olivamidopropyl betaines, palmamidopropyl betaines, palmitamidopropyl betaines, palmitoyl carnitine, palm kernel amidopropyl betaines, polytetrafluoroethylene acetoxypropyl betaines, ricinole amidopropyl betaines, sesamidopropyl betaines, soyamidopropyl betaines, stearamidopropyl betaines, stearyl betaines, tallow amidopropyl betaines, tallow amidopropyl hydroxysultaine, tallow betaines, tallow dihydroxyethyl betaines, undecylenamidopropyl betaines and wheat germ amidopropyl betaines. Preferred betaine is for example cocamidopropyl betaines.

Cationic Surfactants

The cationic surfactants, when present, are present in an effective amount, more preferably from 0.01% to 10%, by weight of the alkaline liquid hand dish washing detergent composition. Suitable cationic surfactants are quaternary ammonium surfactants. Suitable quaternary ammonium surfactants are selected from the group consisting of mono $C_6$-$C_{16}$, preferably $C_6$-$C_{10}$ N-alkyl or alkenyl ammonium surfactants, wherein the remaining N positions are substituted by methyl, hydroxyehthyl or hydroxypropyl groups. Another preferred cationic surfactant is $C_6$-$C_{18}$ alkyl or alkenyl ester of a quaternary ammonium alcohol, such as quaternary chlorine esters. More preferably, the cationic surfactants have the following formula:

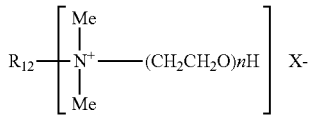

wherein $R_{12}$ is $C_8$-$C_{18}$ hydrocarbyl and mixtures thereof, preferably, $C_{8-14}$ alkyl, more preferably, $C_8$, $C_{10}$ or $C_{12}$ alkyl, and X is an anion, preferably, chloride or bromide.

The additional surfactant system, when present is comprised at a level of 0.01% to 30%, preferably 0.1% to 20%, more preferably 1.5% to 10% by weight of the alkaline liquid hand dish washing detergent composition.

Cleaning Polymer

The composition of the present invention can further comprise one or more alkoxylated polyethyleneimine polymer.

The alkoxylated polyethyleneimine polymer of the present composition has a polyethyleneimine backbone having from 400 to 10000 weight average molecular weight; preferably from 400 to 7000 weight average molecular weight, alternatively from 3000 to 7000 weight average molecular weight.

These polyamines can be prepared for example, by polymerizing ethyleneimine in presence of a catalyst such as carbon dioxide, sodium bisulfite, sulfuric acid, hydrogen peroxide, hydrochloric acid, acetic acid, and the like.

The alkoxylation of the polyethyleneimine backbone includes: (1) one or two alkoxylation modifications per nitrogen atom, dependent on whether the modification occurs at a internal nitrogen atom or at an terminal nitrogen atom, in the polyethyleneimine backbone, the alkoxylation modification consisting of the replacement of a hydrogen atom on a polyalkoxylene chain having an average of about 1 to about 40 alkoxy moieties per modification, wherein the terminal alkoxy moiety of the alkoxylation modification is capped with hydrogen, a $C_1$-$C_4$ alkyl or mixtures thereof; (2) a substitution of one $C_1$-$C_4$ alkyl moiety or benzyl moiety and one or two alkoxylation modifications per nitrogen atom, dependent on whether the substitution occurs at a internal nitrogen atom or at an terminal nitrogen atom, in the polyethyleneimine backbone, the alkoxylation modification consisting of the replacement of a hydrogen atom by a polyalkoxylene chain having an average of about 1 to about 40 alkoxy moieties per modification wherein the terminal alkoxy moiety is capped with hydrogen, a $C_1$-$C_4$ alkyl or mixtures thereof; or (3) a combination thereof.

The composition may further comprise the amphiphilic graft polymers based on water soluble polyalkylene oxides (A) as a graft base and sides chains formed by polymerization of a vinyl ester component (B), said polymers having an average of ≦1 graft site per 50 alkylene oxide units and mean molar mass Mw of from 3,000 to 100,000 described in BASF patent application WO2007/138053 on pages 2 line 14 to page 10, line 34 and exemplified on pages 15-18.

The composition may comprise an alkoxylated polyethyleneimine polymer as described on page 2, line 33 to page 5, line 5 and exemplified in examples 1 to 4 at pages 5 to 7 of WO2007/135645 at levels from 0.01% to 10%, preferably from 0.01% to 2%, more preferably from 0.1% to 1.5%, even more preferable from 0.2% to 1.5% by weight of the alkaline liquid hand dish washing detergent composition.

Solvents

Solvents are generally used to ensure preferred product quality for dissolution, thickness and aesthetics and to ensure better processing. Thereof the composition herein may comprise a solvent or a mixture thereof as optional ingredient.

Suitable solvents include $C_1$-$C_5$ alcohols are according to the formula R—OH wherein R is a linear saturated alkyl group of from 1 to 5 carbon atoms, preferably from 2 to 4. Suitable alcohols are ethanol, propanol, isopropanol or mixtures thereof. Other suitable alcohols are alkoxylated $C_{1-8}$ alcohols according to the formula R (AON—OH wherein R is a linear alkyl group of from 1 to 8 carbon atoms, preferably from 3 to 6, wherein A is an alkoxy group preferably propoxy and/or ethoxy and n is an integer of from 1 to 5, preferably from 1 to 2. Suitable alcohols are buthoxy propoxy propanol (n-BPP), buthoxy Propanol (n-BP) buthoxyethanol or mixtures thereof. Suitable alkoxylated aromatic alcohols to be used herein are according to the formula R(B)n-OH wherein R is an alkyl substituted or non alkyl substituted aryl group of from 1 to 20 carbon atoms, preferably from 2 to 15 and more preferably from 2 to 10, wherein B is an alkoxy group preferably buthoxy, propoxy and/or ethoxy and n is an integer from of from 1 to 5, preferably from 1 to 2. Suitable alkoxylated aromatic alcohols are benzoyethanol and or benzoypropanol. A suitable aromatic alcohol to be used herein is benzyl alcohol. Other suitable solvenst include butyl diglycolether, benzylalcohol, propoxy-porpoxypropanol (EP 0 859 044) ethers and diethers, glycols like polypropylene glycol, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof.

When present, alkaline liquid hand dish washing detergent composition will contain effective amount, preferably from 0.001% to 20%, solvent by weight of the alkaline liquid hand dishwashing detergent composition. These solvents may be used in conjunction with an aqueous liquid carrier, such as water, or they may be used without any aqueous liquid carrier being present.

Hydrotrope

The compositions of the present invention may optionally comprise a hydrotrope in an effective amount so that the liquid detergent compositions are appropriately compatible in water. Suitable hydrotropes to be used herein include anionic-type hydrotropes, particularly sodium, potassium, and ammonium xylene sulphonate, sodium, potassium and ammonium toluene sulphonate, sodium potassium and ammonium cumene sulphonate, and mixtures thereof, and related compounds, as disclosed in U.S. Pat. No. 3,915,903. When present, alkaline liquid hand dish washing detergent composition of the present invention, will comprise a hydrotrope, or mixtures thereof at levels from 0% to 15% by weight of the alkaline liquid hand dishwashing detergent composition, preferably from 1% to 10%, more preferably from 3% to 6% by weight of the alkaline liquid hand dish washing detergent composition.

Polymeric Suds Stabilizer

The compositions of the present invention may optionally contain a polymeric suds stabilizer. These polymeric suds stabilizers provide extended suds volume and suds duration of the liquid detergent compositions. These polymeric suds stabilizers may be selected from homopolymers of (N,N-dialkylamino) alkyl esters and (N,N-dialkylamino) alkyl acrylate esters. The weight average molecular weight of the polymeric suds boosters, determined via conventional gel permeation chromatography, is from 1,000 to 2,000,000, preferably from 5,000 to 1,000,000, more preferably from 10,000 to 750,000, more preferably from 20,000 to 500,000, even more preferably from 35,000 to 200,000. The polymeric suds stabilizer can optionally be present in the form of a salt, either an inorganic or organic salt, for example the citrate, sulphate, or nitrate salt of (N,N-dimethylamino)alkyl acrylate ester.

One preferred polymeric suds stabilizer is (N,N-dimethylamino)alkyl acrylate esters, namely the acrylate ester represented by the following formula:

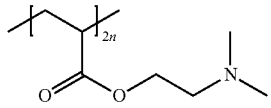

Other preferred suds boosting polymers are copolymers of hydroxypropylacrylate/dimethyl aminoethylmethacrylate (copolymer of HPA/DMAM), represented by the following formulas

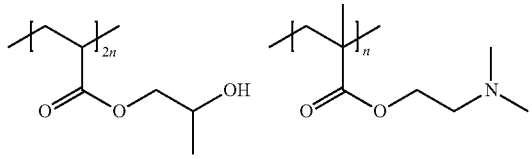

Another preferred class of polymeric suds booster polymers are hydrophobically modified cellulosic polymers having a number average molecular weight (Mw) below 45,000; preferably between 10,000 and 40,000; more preferably between 13,000 and 25,000. The hydrophobically modified cellulosic polymers include water soluble cellulose ether derivatives, such as nonionic and cationic cellulose derivatives. Preferred cellulose derivatives include methylcellulose, hydroxypropyl methylcellulose, hydroxyethyl methylcellulose, and mixtures thereof.

When present in the compositions of present invention, the polymeric suds booster/stabilizer may be present in the composition from 0.01% to 15%, preferably from 0.05% to 10%, more preferably from 0.1% to 5%, by weight of the alkaline liquid hand dishwashing detergent composition.

Diamines

Another optional ingredient of the compositions according to the present invention is a diamine. Preferred organic diamines are those in which $pK_1$ and $pK_2$ are in the range of 8.0 to 11.5, preferably in the range of 8.4 to 11, even more preferably from 8.6 to 10.75. Preferred materials include 1,3-bis(methylamine)-cyclohexane ($pK_a$=10 to 10.5), 1,3 propane diamine ($pK_1$=10.5; $pK_2$=8.8), 1,6 hexane diamine ($pK_1$=11; $pK_2$=10), 1,3 pentane diamine (DYTEK EP®) ($pK_1$=10.5; $pK_2$=8.9), 2-methyl 1,5 pentane diamine (DYTEK A®) ($pK_1$=11.2; $pK_2$=10.0). Other preferred materials include primary/primary diamines with alkylene spacers ranging from $C_4$ to $C_8$. In general, it is believed that primary diamines are preferred over secondary and tertiary diamines. $pK_a$ is used herein in the same manner as is commonly known to people skilled in the art of chemistry: in an all-aqueous solution at 25° C. and for an ionic strength between 0.1 to 0.5 M. Values referenced herein can be obtained from literature, such as from "Critical Stability Constants: Volume 2, Amines" by Smith and Martel, Plenum Press, NY and London, 1975.

The alkaline liquid hand dish washing detergent composition herein can further comprise at least one diamine preferably at the level from 0.001% to 15%, preferably 0.2% to 10%, more preferably 0.25% to 6%, most preferably 0.5% to 1.5% by weight of the alkaline liquid hand dish washing detergent composition.

Carboxylic Acid

The alkaline liquid hand dish washing detergent compositions according to the present invention may comprise a linear or cyclic carboxylic acid or salt thereof to improve the rinse feel of the composition. The presence of anionic surfactants, especially when present in higher amounts in the region of 15-35% by weight of the composition, results in the composition imparting a slippery feel to the hands of the user and the dishware.

Carboxylic acids useful herein include $C_{1-6}$ linear or at least 3 carbon containing cyclic acids. The linear or cyclic carbon-containing chain of the carboxylic acid or salt thereof may be substituted with a substituent group selected from the group consisting of hydroxyl, ester, ether, aliphatic groups having from 1 to 6, more preferably 1 to 4 carbon atoms, and mixtures thereof.

Preferred carboxylic acids are those selected from the group consisting of salicylic acid, maleic acid, acetyl salicylic acid, 3-methyl salicylic acid, 4-hydroxy isophthalic acid, dihydroxyfumaric acid, 1,2,4-benzene tricarboxylic acid, pentanoic acid and salts thereof, citric acid and salts thereof and mixtures thereof. Where the carboxylic acid exists in the salt form, the cation of the salt is preferably selected from alkali metal, alkaline earth metal, monoethanolamine, diethanolamine or triethanolamine and mixtures thereof.

The carboxylic acid or salt thereof, when present, is preferably present at the level of from 0.1% to 5%, more preferably from 0.2% to 1% and most preferably from 0.25% to 0.5% by weight of alkaline liquid hand dishwashing detergent composition.

Bleach Stable Perfume:

The alkaline liquid hand dish washing detergent compositions according to the present invention may comprise a bleach-stable perfume. The bleach-stable perfume compositions suitable for the present invention are perfume compositions which do not contain alkenyl or alkynyl groups and have a peracid stability value (PSV) of at least 65% and are selected from the group consisting of saturated alcohols, esters, aromatic ketones, lactones, nitriles, ethers, acetals, phenols, hydrocarbons and aromatic nitromusks and mixtures thereof.

PSV Value Test Method:

The alkaline liquid hand dish washing detergent composition (100 g) was dosed with perfume material (0.3 g) and was blended for 5 minutes. Small amount of sample were taken for initial analysis and the reminder was sampled into two sealed glass jars. The glass jar samples were stored at 0° C. (control sample) and 37° C. for 4 weeks. After storage, the perfume was extracted from the samples by using solvent extraction with suitable solvent and analysed by gas-chromatography (GC) to determine the percentage of each perfume ingredient remaining relative to the control.

Bleach Stable Dyes:

The alkaline liquid hand dish washing detergent compositions according to the present invention may be clear or colored. Such coloration, when present, is preferentially achieved with bleach stable coloring agents, more preferentially with bleach stable coloring agent such as pigments. Suitable bleach stable coloring agents for the present invention are selected from the group consisting of cobalt blue, cobalt aluminate blue pigment, Ultramarine Blue and its equivalents, Cosmenyl Blue A2R from Clariant and phthalocyanine-based water dispersible pigments and mixtures thereof.

Other Optional Components:

The alkaline liquid hand dish washing detergent compositions according to the present invention can further comprise a number of other optional ingredients suitable to be used in liquid detergent compositions such as, pearlescent agents, opacifiers, stannates, enzymes preferably a protease, structurants, thickening agents, preservatives, disinfecting agents.

A further discussion of acceptable optional ingredients suitable to be used in light-duty liquid detergent composition may be found in U.S. Pat. No. 5,798,505.

pH pH buffering means so that the alkaline liquid hand dish washing detergent compositions herein generally have a pH of from 8.0 to 10.0, preferably from 8.0 to 8.9, most preferably from 8.5 to 8.9. The pH of the composition can be adjusted using pH modifying ingredients known in the art.

Viscosity

The compositions of the present invention preferably have viscosity from 50 to 2000 centipoises (50-2000 mPa*s), more preferably from 100 to 1500 centipoises (100-1500 mPa*s), and most preferably from 500 to 1300 centipoises (500-1300 mPa*s) at $20^{s-1}$ and 20° C. Viscosity can be determined by conventional methods. Viscosity according to the present invention is measured using an AR 550 rheometer from TA instruments using a plate steel spindle at 40 mm diameter and a gap size of 500 μm. The high shear viscosity at $20^{s-1}$ and low shear viscosity at $0.05^{s-1}$ can be obtained from a logarithmic shear rate sweep from $0.1^{s-1}$ to $25^{s-1}$ in 3 minutes time at 20° C. The preferred rheology described therein may be achieved using internal existing structuring with detergent ingredients or by employing an external rheology modifier. Hence, in a preferred embodiment of the present invention, the composition comprises further a rheology modifier.

The Process of Cleaning/treating a Dishware

The process of dishwashing of the present invention comprises cleaning a dishware with an alkaline liquid hand dish washing detergent composition. Said dishwashing process comprises the steps of applying said composition onto said dishware, typically in diluted or neat form and rinsing said composition from said surface, or leaving said composition to dry on said surface without rinsing said surface. Instead of leaving said composition to dry on said surface on the air, it can also be hand-dried using a kitchen towel. During the dishwashing process, particularly during the application of said alkaline liquid hand dish washing detergent composition to the dishware and/or rinsing away of said liquid composition from the dishware, the hands and skin of the user may be exposed to the an alkaline liquid hand dish washing detergent composition in diluted or neat form.

By "in its neat form", it is meant herein that said alkaline liquid hand dish washing detergent composition is applied directly onto the surface to be treated without undergoing any dilution by the user (immediately) prior to the application. This direct application of that said liquid composition onto the surface to be treated can be achieved through direct squeezing of that said liquid composition out of the hand dishwashing liquid bottle onto the surface to be cleaned, or through squeezing that said liquid composition out of the hand dishwashing liquid bottle on a pre-wetted or non pre-wetted cleaning article, such as without intending to be limiting a sponge, a cloth or a brush, prior to cleaning the targeted surface with said cleaning article. By "diluted form", it is meant herein that said liquid composition is diluted by the user with an appropriate solvent, typically with water. By "rinsing", it is meant herein contacting the dishware cleaned with the process according to the present invention with substantial quantities of appropriate solvent, typically water, after the step of applying alkaline liquid hand dish washing detergent composition herein onto said dishware. By "substantial quantities", it is meant usually 0.1 to 20 liters.

In one embodiment of the present invention, the composition herein can be applied in its diluted form. Soiled dishes are contacted with an effective amount, typically from 0.5 ml to 20 ml (per 25 dishes being treated), preferably from 3 ml to 10 ml, of alkaline liquid hand dish washing detergent composition of the present invention diluted in water. The actual amount of liquid detergent composition used will be based on the judgment of user, and will typically depend upon factors such as the particular product formulation of the composition, including the concentration of active ingredients in the composition, the number of soiled dishes to be cleaned, the degree of soiling on the dishes, and the like. The particular product formulation, in turn, will depend upon a number of factors, such as the intended market (i.e., U.S., Europe, Japan, etc.) for the composition product. Typical light-duty detergent compositions are described in the examples section.

Generally, from 0.01 ml to 150 ml, preferably from 3 ml to 40 ml, even more preferably from 3 ml to 10 ml of an alkaline liquid hand dish washing detergent composition of the invention is combined with from 2000 ml to 20000 ml, more typically from 5000 ml to 15000 ml of water in a sink having a volumetric capacity in the range of from 1000 ml to 20000 ml, more typically from 5000 ml to 15000 ml. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface, and is typically contacted with the dish surface for a period of time ranged from 1 to 10 seconds, although the actual time will vary with each application and user. The contacting of cloth, sponge, or similar article to the dish surface is preferably accompanied by a concurrent scrubbing of the dish surface.

Another process of the present invention will comprise immersing the soiled dishes into a water bath or held under running water without any alkaline liquid detergent composition. A device for absorbing alkaline liquid hand dish washing detergent composition, such as a sponge, is placed directly into a separate quantity of a concentrated pre-mix of diluted alkaline liquid hand dish washing detergent composition, for a period of time typically ranging from 1 to 5 seconds. The absorbing device, and consequently the diluted alkaline liquid hand dish washing detergent, is then contacted individually to the surface of each of the soiled dishes to remove said soiling. The absorbing device is typically contacted with each dish surface for a period of time range from 1 to 10 seconds, although the actual time of application will be dependent upon factors such as the degree of soiling of the dish. The contacting of the absorbing device to the dish surface is preferably accompanied by concurrent scrubbing. Typically, said concentrated pre-mix of diluted liquid dishwashing detergent is formed by combining 1 ml to 200 ml of neat dishwashing detergent with 50 ml to 1500 ml of water, more typically from 200 ml to 1000 ml of water.

Packaging

The alkaline liquid hand dish washing detergent compositions of the present invention may be packaged in any suitable packaging for delivering the liquid detergent composition to be used. Preferably the package is made of plastic. Most suitable materials for package are polyethylene terephtalate (PET), high density polyethylene (HDPE) and polyethylene (PE). The shape of the package is preferably rounded bottle and bottle is preferably either perforated or vented.

EXAMPLES

The following non limiting examples are illustrative of the present invention. Percentages are by weight unless otherwise specified.

| | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|
| $H_2O_2$ | 6 | 5 | 2 | 6 | 6 | 6 | 5 | 2 | 2 |
| C11-C14 AE3S | — | — | — | 12.0 | 28 | — | — | — | — |
| C11-C14 AE0.6S With 23% branching | 13 | 13 | 13 | — | — | 16 | 20 | 23 | 27 |
| C12-C14 dimethyl amine oxide | 3 | 3 | 3 | 4 | 3 | 4 | 5 | 5 | 6 |
| trimethoxy benzoic acid (TMBA) | 0.06 | 0.06 | — | 0.06 | 0.06 | 0.06 | 0.06 | 0.06 | 0.06 |
| 1-hydroxyethylidene 1,1-diphosphonic acid (HEDP) | 0.1 | 0.1 | — | 0.1 | 0.1 | 0.1 | 0.1 | 0.1 | 0.1 |
| Ethanol | 3.0 | 3.0 | 3.0 | 3.0 | 3.0 | 2 | 2 | 2 | 2 |
| NaCl | — | — | 1.0 | 1.0 | 1.0 | 1.0 | 1.0 | 1.0 | 1.0 |
| Polypropyleneglycol | — | — | — | — | 0.4 | 0.5 | 0.5 | 0.5 | 0.5 |
| Sodium citrate | — | — | — | — | 5 | — | — | — | — |
| $H_2O$ + miscellaneous | To 100 | To 100 | To 100 | To 100 | To 100 | To 100 | To 100 | To 100 | To 100 |

AE3S - anionic alkyl(ether)3sulphate surfactant
AE0.6S - anionic alkyl(ether)0.6sulphate surfactant Stability and Performance Stability at high temperature was followed up to 3+ months. Samples were prepared for Available $O_2$ (Av. $O_2$) analysis at time points: fresh, 1 week, 2 weeks, 1 month, 3 months and 3+ months.

FIG. 1 $H_2O_2$ Stability at Various Storage Conditions for a Formula of Example 1.

Test Method:

The test method determines the available oxygen (Av. $O_2$) retained in final product after exposure to 20° C., 32° C. and 50° C. in controlled temperature room (CTR), over time. An iodometric titration procedure is used to determine the initial and ongoing available oxygen levels in the test sample. The stability is reported as the % available oxygen retained (=% of recovery) and the results are indicative of stability of hydrogen peroxide in final products.

Procedure:

- Prepare formula to be tested in stability testing
- Check parameters of fresh product (pH, viscosity, $AvO_2$, etc.) and record data.
- Pour sample into PE lab bottles (250 ml) from Kartell and commercial PET Mars bottles (450 ml)
- Fill the bottles with the same weight of product
- Store the sealed bottles in the same CTR for set duration
- Shake bottles prior to sampling for $AvO_2$ analysis
- The sodium thiosulphate (0.1N) titration of $AvO_2$ is automated (Mettler DL70)
  - Weight 0.0001 g of product to be tested in a titration vessel
  - Add 30 ml of acetic acid into the sample in the titration vessel
  - Add 10 ml of deionised water into the sample
  - Add 6 ml of ethanol into the sample
  - Add 10 ml of KI 40% into the sample
  - Titrate with standard 0.1N sodim thiosulphate to the potentiometric endpoint, using a platinum electrode Results:

98% recovery at 20° C. and 32° C.

85% recovery at 50° C.

The composition has UV exposure during the storage. UV exposure was tested by following the ISO 4892 guidelines. After UV exposure sample (Ex. 6) was analysed by analytical methods to measure the Available Oxygen (Av. O2) according to test method described above. This test method stimulates an indoor light exposure of 6 to 9 months.

Results:

% recovery after 48 h UV exposure was equal to 99% which is an indication of the hydrogen peroxide stability in finish product.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An alkaline liquid hand dish washing detergent composition comprising less than about 80% water by weight of the composition and comprising:

a) hydrogen peroxide or a water-soluble source thereof or mixture thereof, b) an anionic surfactant or mixture thereof;

c) an amine oxide surfactant or mixture thereof;

d) a chelant or mixture thereof, and e) a free radical scavenger or mixture thereof, wherein the composition has a pH from about 8.0 to about 10.0 and the composition is free of additional surfactants, wherein the free radical scavenger is selected from the group consisting of guaiacol, tetrabutyl ethylidinebisphenol, and mixtures thereof.

2. An alkaline liquid hand dish washing detergent composition according to claim 1 wherein the hydrogen peroxide is present at a level of from about 0.1% to about 15% by weight of the alkaline liquid hand dish washing detergent composition.

3. An alkaline liquid hand dish washing detergent composition according claim 2 wherein said anionic surfactant is selected from the group consisting of sulfate surfactants, sulfosuccinate surfactants, sulfoacetate surfactants, sulfonate surfactants and mixtures thereof.

4. An alkaline liquid hand dish washing detergent composition according claim 3 wherein said anionic surfactant is present at a level of from about 12% to about 60% by weight of the alkaline liquid hand dishwashing detergent composition.

5. An alkaline liquid hand dish washing detergent composition according to claim 4 wherein said amine oxide surfactant is present at a level of from about 1% to about 12% by weight of the alkaline liquid hand dish washing detergent composition.

6. An alkaline liquid hand dish washing detergent composition according to claim 5 wherein said amine oxide surfactant is selected from the group consisting of linear amine oxide, linear $C_{10}$, linear $C_{10}$-$C_{12}$, and linear $C_{12}$-$C_{14}$ alkyl dimethyl amine oxides and mixtures thereof.

7. An alkaline liquid hand dish washing detergent composition according to claim 1 wherein chelant is selected from the group consisting of 1-hydroxy ethylidene-1,1-diphosphonic acid, diethylene triamine penta acetic acid, N,N-diacetic glytamic acid tetra sodium salt methyl glycine -N,N-di acetic acid and mixtures thereof.

8. An alkaline liquid hand dish washing detergent composition according to claim 1 further comprises a solvent selected from the group consisting of ethanol, propanol, isopropanol, buthoxy propoxy propanol, buthoxy propanol, buthoxy ethanol, benzoyethanol, benzoypropanol, buthyl diglycoether, benzyl alcohol, propoxy propoxy propanol, polypropylene glycol, alkoxylated glycols, $C_6$-$C_{16}$ glycol ethers, alkoxylated aromatic alcohols, aliphatic brached alcohols, alkoxylated aliphatic alcohols, alkoxylated linear $C_1$-$C_5$ alcohols, linear $C_1$-$C_5$ alcohols, amines, $C_8$-$C_{14}$ alkyl and cycloalkyl hydrocarbons, halogenated hydrocarbons and mixtures thereof.

9. An alkaline liquid hand dish washing detergent composition according to claim 8 which further comprises bleach stable dye, wherein said bleach stable dye is selected from the group consisting of cobalt blue, cobalt aluminate blue pigment, ultramarine blue and its equivalents, phthalocyanine-based water dispersible pigments and mixtures thereof.

10. An alkaline liquid hand dish washing detergent composition according to claim 9 which further comprises bleach stable perfume composition wherein said bleach stable perfume composition do not contain alkenyl or alkynyl groups and have a peracid stability value (PVS) of at least 65% and are selected from the group consisting of saturated alcohols, esters, aromatic ketones, lactones, nitriles, ethers, acetals, phenols hydrocarbons and aromatic nitromusks and mixtures thereof.

11. A process of dishwashing with an alkaline liquid hand dish washing detergent composition according to claim 1, wherein said process comprises the steps of applying said composition onto said dishware having contact time from about 1 s to about 120 s.

12. The composition of claim 1, wherein:

(a) the hydrogen peroxide is present at a level of from about 0.3% to about 6% by weight of the alkaline liquid hand dish washing detergent composition;

(b) the anionic surfactant is present at a level from about 14% to about 50% by weight of the alkaline liquid hand dish washing detergent composition, and wherein the anionic surfactant is selected from the group consisting of sulfate alkylsulfate surfactants, alkyl ethoxy sulfonate surfactants having average ethoxylation degree from about 0.01 to about 10, (c) the amine oxide surfactant is present from about 1% to 10% by weight of the alkaline liquid hand dish washing detergent composition; and (d) pH from about 8 to about 8.9.

13. The composition of claim 12, wherein:

(a) the anionic surfactant has an average ethoxylation degree from 0.03 to about 3, and wherein the anionic surfactant is from about 16% to about 40% by weight of the composition;

(b) the amine oxide surfactant is present from about 3% to 6% by weight of the composition;

(c) the amine oxide surfactant is selected from the group consisting of linear amine oxide, linear $C_{10}$, linear $C_{10}$-$C_{12}$, and linear $C_{12}$-$C_{14}$ alkyl dimethyl amine oxides and mixtures thereof;

(d) the chelant is selected from the group consisting of 1-hydroxy ethylidene-1,1-diphosphonic acid, diethylene triamine penta acetic acid, N,N-diacetic glytamic acid tetra sodium salt, methyl glycine -N,N-diacetic acid and mixtures thereof;

(e) the free radical scavenger is tetrabutyl ethylidinebisphenol;

(f) the pH is from 8.5 to 8.9;

(g) a solvent, wherein the solvent is selected from the group consisting of ethanol, propanol, isopropanol, buthoxy propoxy propanol, buthoxy propanol, buthoxy ethanol, benzoyethanol, benzoypropanol, buthyl diglycoether, benzyl alcohol, propoxy propoxy propanol, polypropylene glycol, alkoxylated glycols, $C_6$-$C_{16}$ glycol ethers, alkoxylated aromatic alcohols, aliphatic brached alcohols, alkoxylated aliphatic alcohols, alkoxylated linear $C_1$-$C_5$ alcohols, linear $C_1$-$C_5$ alcohols, amines, $C_8$-$C_{14}$ alkyl and cycloalkyl hydrocarbons, halogenated hydrocarbons and mixtures thereof;

(h) a bleach stable dye, wherein said bleach stable dye is selected from the group consisting of cobalt blue, cobalt aluminate blue pigment, ultramarine blue and its equivalents, phthalocyanine-based water dispersible pigments and mixtures thereof; and (i) a bleach stable perfume composition wherein said bleach stable perfume composition do not contain alkenyl or alkynyl groups and have a peracid stability value (PVS) of at least 65% and are selected from the group consisting of saturated alcohols, esters, aromatic ketones, lactones, nitriles, ethers, acetals, phenols hydrocarbons and aromatic nitromusks and mixtures thereof.

14. A process of dishwashing with an alkaline liquid hand dish washing detergent composition according to claim 12, wherein said process comprises the steps of applying said composition onto said dishware having contact time from about 1 s to about 120 s.

15. A process of dishwashing with an alkaline liquid hand dish washing detergent composition according to claim 13, wherein said process comprises the steps of applying said composition onto said dishware having contact time from about 1 s to about 120 s.

* * * * *